United States Patent [19]

Inoue et al.

[11] Patent Number: 4,880,351

[45] Date of Patent: Nov. 14, 1989

[54] VARIABLE CAPACITY TURBINE

[75] Inventors: Kazuo Inoue; Osamu Kubota; Shunji Yano; Fusao Tateishi; Etsuo Noda; Koji Yamaguchi; Tsuneo Endo, all of Wako, Japan

[73] Assignee: Honda Giken Kogyo Kabushiki Kaisha, Tokyo, Japan

[21] Appl. No.: 54,499

[22] Filed: May 27, 1987

[30] Foreign Application Priority Data

May 30, 1986 [JP] Japan ..... 61-124996
May 30, 1986 [JP] Japan ..... 61-124997
May 30, 1986 [JP] Japan ..... 61-124998

[51] Int. Cl.[4] ..... F01D 17/16
[52] U.S. Cl. ..... 415/164; 415/159
[58] Field of Search ..... 415/148, 151, 159, 162, 415/163, 164, 167, 202

[56] References Cited

U.S. PATENT DOCUMENTS

| | | | |
|---|---|---|---|
| 2,382,913 | 8/1945 | Robinson | 415/148 |
| 2,428,830 | 10/1947 | Birmann | 60/39.161 |
| 2,648,195 | 8/1953 | Wilde et al. | 415/164 |
| 2,671,635 | 3/1954 | Willi | 415/164 |
| 2,860,827 | 11/1958 | Egli | 415/164 |
| 2,895,925 | 7/1959 | Carlson | 60/39.161 |
| 3,101,926 | 8/1963 | Weber | 415/164 |
| 3,442,493 | 5/1969 | Smith, Jr. | 415/164 |
| 4,232,992 | 11/1980 | Possell | 415/164 |
| 4,678,397 | 7/1987 | Komatsu et al. | 415/151 |
| 4,684,319 | 8/1987 | Sasaki | 415/164 |
| 4,702,672 | 10/1987 | Leicht et al. | 415/164 |
| 4,770,603 | 9/1988 | Engels et al. | 415/164 |
| 4,780,054 | 10/1988 | Yano et al. | 415/164 |

FOREIGN PATENT DOCUMENTS

| | | | |
|---|---|---|---|
| 0034915 A1 | 9/1981 | European Pat. Off. . | |
| 1033965 | 7/1958 | Fed. Rep. of Germany | 415/164 |
| 1952423 | 5/1971 | Fed. Rep. of Germany . | |
| 2389760 | 12/1977 | France . | |
| 387653 | 8/1961 | Japan . | |
| 53-136113 | 3/1978 | Japan . | |
| 102824 | 1/1924 | Switzerland . | |
| 127459 | 9/1928 | Switzerland | 415/164 |
| 129731 | 4/1945 | Switzerland | 415/164 |
| 422214 | 4/1967 | Switzerland . | |
| 383894 | 10/1973 | U.S.S.R. | 415/164 |
| 715812 | 2/1980 | U.S.S.R. | 415/164 |
| 2143591A | 2/1985 | United Kingdom . | |

*Primary Examiner*—Robert E. Garrett
*Assistant Examiner*—John T. Kwon
*Attorney, Agent, or Firm*—Nixon & Vanderhye

[57] ABSTRACT

Disclosed is a turbine comprising a turbine wheel, a turbine scroll passage defined in a turbine casing around the turbine wheel for introduction of gas to the turbine wheel, and an axial central passage defined in the turbine casing for ejection of gas from the turbine wheel, wherein: a plurality of variable nozzles are arranged outside of a throat section having a locally minimum cross section which is defined in the turbine casing around the turbine wheel. The variable nozzles may be defined by fixed vanes and moveable vanes which cooperate with each other in such a manner that each of the moveable vanes and the corresponding fixed vane define a substantially smooth and continuous airfoil. The moveable vanes may be pivotally supported by a back plate of the casing while the fixed vanes may be integrally provided with a fixed vane member having a disk portion which defines a surface opposing the inner surface of the back plate. The moveable vanes may rotate along and between these mutually opposing surfaces for varying the cross section of the nozzles defined between the fixed vanes and the moveable vanes.

17 Claims, 6 Drawing Sheets

VARIABLE CAPACITY TURBINE

TECHNICAL FIELD

The present invention relates to a variable capacity turbine and in particular to a variable capacity turbine suitable for use in a turbosupercharger which is simple in structure and can yet maintain a high level of efficiency even when the velocity of the fluid supplied to the turbine is low.

BACKGROUND OF THE INVENTION

In the radial turbine which is typically employed as an exhaust gas turbine of a turbosupercharger, it is often desirable to be able to supercharge the engine even at a relatively low engine speed and this can be achieved by increasing the velocity of the exhaust gas entering the turbine by restricting the cross section of the passage leading to the turbine wheel. However, when the passage is restricted, the inlet pressure of the turbine or the back pressure of the engine exhaust system rises and the efficiency of the engine drops.

Therefore, if a plurality of moveable vanes are arranged in a throat located adjacent the outer circumference of a turbine wheel in a circle so that the area of the nozzles defined between the moveable vanes may be varied by rotating the moveable vanes over a certain angle as described in Japanese Patent Publication No. 38-7653, it is possible to ensure supercharging of the engine in a low speed range of the engine and, at the same time, to keep the back pressure of the engine exhaust system to a low level in a medium to high speed range of the engine.

However, in this structure, since the vanes are placed in the region where the velocity of the fluid flow is relatively high, the resistance loss of the fluid tends to be great and, therefore, the efficiency of the turbine tends to drop. And, since the nozzles are defined between neighboring moveable vanes, a slight error in the angle of the vanes causes a significant change in the opening area of the nozzles particularly when the opening area of the nozzles is small and, therefore, a difficulty arises in ensuring a control precision. When this turbine is applied as an exhaust turbine in a turbosupercharger, since these vanes are exposed to an exhaust gas flow of high temperature, it is difficult to adjust these vanes with a high level of reliability.

Furthermore, since the vanes defining the variable nozzles are arranged to rotate along and between the inner surface of the turbine casing and the inner surface of the back plate which closes the turbine wheel bearing end of the casing and the thermal expansion of the turbine casing having a complicated shape is highly uneven, the gap control of the variable nozzles particularly in a high temperature environment could be a serious problem.

As disclosed in Japanese Patent Laid Open Publication 53-136113, it is previously known to change the cross sectional area of a scroll passage of a turbine casing by providing a moveable flap which defines a part of the wall of the scroll passage. In this variable nozzle structure, the velocity of fluid flowing into the turbine wheel can be adjusted without involving much resistance loss with a simple structure, but the range of variation is not as wide as desired and particularly when the flap opening is great the flow heading toward the turbine wheel tends to be disturbed with the result that the distribution of the fluid velocity tends to be uneven and, therefore, the efficiency of the turbine drops.

BRIEF SUMMARY OF THE INVENTION

In view of such problems of the prior art, a primary object of the present invention is to provide a variable capacity turbine which can operate even when the flow rate of the fluid entering the turbine is small and, yet, allows the passage of the fluid flow without involving a significant pressure drop when the flow rate of the fluid entering the turbine has increased.

A second object of the present invention is to provide a variable capacity turbine which allows a wide range of variation without increasing the resistance loss of the fluid.

A third object of the present invention is to provide a variable capacity turbine which is capable of controlling the entry velocity of fluid into the turbine wheel with a high level of reliability even in a high temperature environment.

A fourth object of the present invention is to provide a variable capacity turbine in which the clearance of the side edges of the moveable vanes is minimized when the opening of the variable nozzles is small so as to improved the efficiency of the turbine.

A fifth object of the present invention is to provide a variable capacity turbine which is free from the mechanical seizure of the moving parts of the turbine.

These and other object of the present invention can be accomplished by providing a turbine comprising a turbine wheel, a turbine scroll passage defined in a turbine casing around the turbine wheel for introduction of gas to the turbine wheel, and an axial central passage defined in the turbine casing for ejection of gas from the turbine wheel, wherein: a plurality of variable nozzles are arranged outside of a throat section having a locally minimum cross section which is defined in the turbine casing around the turbine wheel. The variable nozzles may be defined by fixed vanes and moveable vanes. Preferably, the fixed vanes are comprised of arcuate vanes arranged along a circle which is concentric to the turbine wheel and the moveable vanes are adapted to rotate along a plane which is perpendicular to the axial line of the turbine.

Thus, since the variable nozzles are provided in the region where the cross sectional area of the flow passage is relatively great the resistance loss of the fluid can be minimized, and since the variable nozzle structure is disposed in an annular arrangement around the outer circumference of the turbine wheel the velocity distribution of the flow entering the turbine wheel can be made uniform even when the nozzle opening is great.

According to a certain aspect of the present invention, the moveable vanes are each provided with a center of rotation at its base end which is adjacent to one of the fixed vanes and are adapted to rotate between a most closed position which is substantially aligned with the circle and a most open position which is inclined inwardly with respect to the circle. Preferably each of the fixed vanes and the corresponding moveable vane define a substantially continuous and smooth airfoil.

According to another aspect of the present invention, the variable capacity turbine of the present invention may comprise a fixed vane member having a disk portion which defines a surface opposing an inner surface of a back plate which covers an axial end of the turbine casing remote from the central axial passage and the fixed vanes arranged at an equal interval along a peripheral portion of the disk portion radially outside of the outer periphery of the turbine wheel and extend axially towards the back plate; moveable vane members having the moveable vanes and pivot means for supporting the moveable vanes in a rotatable manner along and between the opposing surfaces of the disk portion and the back plate; a fastener for connecting an axial free ends of the fixed vanes to the back plate.

Thus, the variable nozzle are defined between the internal surface of the back plate, the opposing surface of disk portion of the fixed vane member which is a separate member from the turbine casing, the fixed vanes and the moveable vane. Since the back plate and the fixed vane member are rigidly connected to each other by the free ends of the fixed vane and the fixed vane member may have a relatively uniform shape, favorable management and control of the gaps of the moveable vanes is possible even when gas of a high temperature is introduced into the turbine and thermal deformation of various parts are caused.

According to yet another aspect of the present invention, the moveable vanes are pivotally supported by the back plate. Preferably, the gap defined by the back plate and the disk portion for receiving one of the moveable vane is flared from an outer circumferential portion thereof to an inner circumferential portion thereof. This feature is helpful because the clearance between the side edges of the movable vane and the back plate and/or the disk portion of the fixed vane member is minimized when the opening of the variable nozzles is small so as to maximize the turbine efficiency, and the clearance of the moveable vanes is maximized when the opening of the variable nozzles is fully open so as to eliminate the possibility of mechanical seizure of the moveable vanes.

According to a certain structurally advantageous feature of the present invention, the disk portion of the fixed vane member is provided with a central tubular portion which is adapted to be connected to an internal end of the axial passage in a substantially air tight and floating manner.

According to yet another aspect of the present invention, the minimum opening angle of the moveable vanes is determined by the side edges of the moveable vanes contacting complementary shoulders formed in at least either one of the back plate and the disk portion of the fixed vane member. This feature ensures a precise positioning of the moveable vanes and minimizes the leakage of the gas from the side edges of the moveable vanes when the opening area of the variable nozzles is at its minimum.

According to yet another aspect of the present invention, an overlap along the circumferential direction is provided between the leading edge of each of the fixed vanes and the trailing edge of the corresponding moveable vane, the ratio of this overlap to the width of the moveable vane being from 20 to 60%, more preferably from 20 to 30%.

BRIEF DESCRIPTION OF THE DRAWINGS

The present invention will now be shown and described in the following in terms of concrete embodiments thereof with reference to the appended drawings, in which.

DETAILED DESCRIPTION OF THE PREFERRED EMBODIMENTS

Now an embodiment of the present invention is described in the following with reference to the appended drawings.

Figure 1:
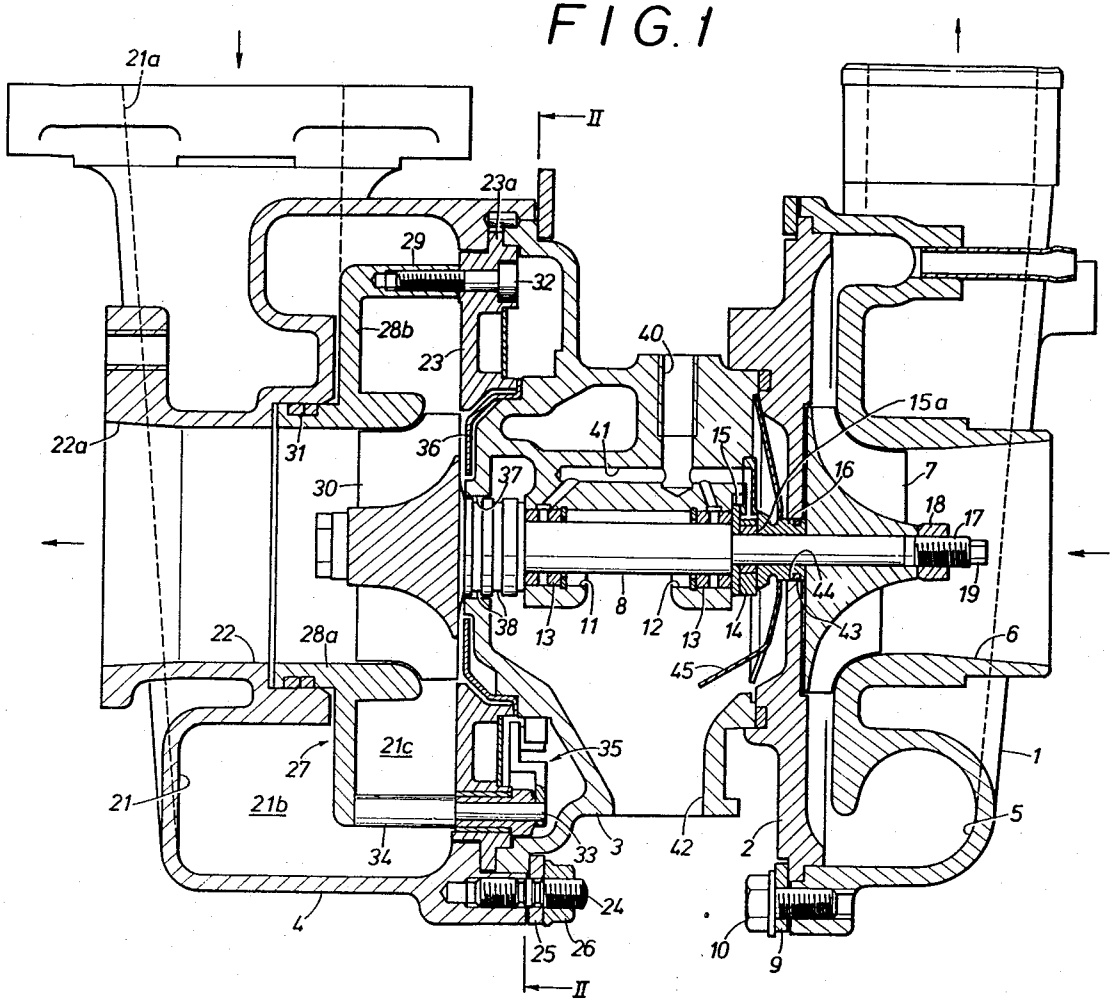
FIG. 1 is a sectional view of a turbosupercharger to which the variable capacity turbine of the present invention is applied.
Figure 2:
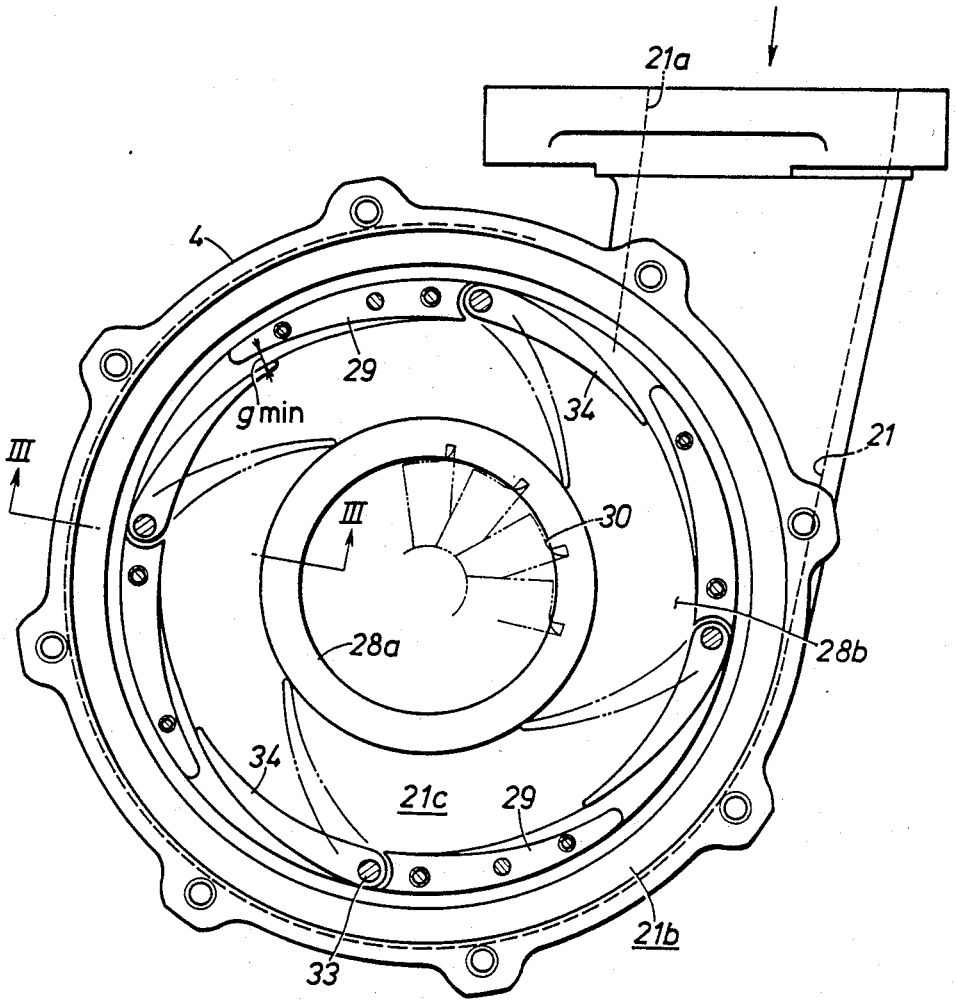
FIG. 2 is a sectional view as seen from line II—II of FIG. 1.

FIGS. 1 and 2 show a turbosupercharger for an engine to which the variable capacity turbine of the present invention is applied. This turbosupercharger comprises an overall casing which consists of a compressor casing 1 which defines a scroll passage of a compressor unit, a back plate 2 which covers the back face of the compressor casing 1, a lubrication unit casing 3 which incorporates a structure for lubricating the main shaft of the turbosupercharger, a turbine casing 4 which defines the scroll passage of the turbine unit, and another back plate 23 which covers the back face of the turbine casing 4.

Inside the compressor casing 1 are defined a scroll passage 5 and an axial passage 6. A compressor wheel 7 is provided in a central part of the scroll passage 5 adjacent the internal end of the axial passage 6. This compressor wheel 7 is mounted to an end of a main shaft 8 of the turbosupercharger, in such manner as described hereinafter, which is supported in a freely rotatable manner in the center of the lubrication unit casing 3. In this compressor unit, the scroll passage 5 serves as an outlet passage for intake air while the axial passage 6 serves as an inlet passage for intake air as indicated by the arrows in FIG. 1.

The compressor casing 1 and the back plate 2 are integrally attached to each other by means of bolts 10 which are threaded with the outer circumferential portion of the compressor casing 1 by way of a ring member 9. The central part of the back plate 2 is provided with a depression which fixedly receives the outer circumferential surface of the lubrication unit casing 3.

The main shaft 8 is supported as mentioned earlier in a pair of bearing holes 11 and 12 defined in the lubrication unit casing 3 by way of radial bearing metals 13. A thrust bearing metal 14 is placed between the back plate 2 and the lubrication unit casing 3, and the support of the main shaft 8 in the thrust direction and the mounting of the compressor wheel 7 on the main shaft 8 are accomplished by fitting a washer 15, a collar 15*a* which is received in a central hole of the thrust bearing metal 14, a bushing 16 and the compressor wheel 7 onto the main shaft in that order with the washer 15 engaging an annular shoulder formed in the main shaft 8 and by threading a nut 18 with a threaded portion 17 formed on the compressor end of the main shaft 8. The collar 15*a* serves as a spacer for controlling the interposing pressure acting on the thrust bearing metal 14.

When threading the nut 18 with the threaded portion 17, by holding a hexagonal cross section portion 19 provided in the free end of the threaded portion 17 with an appropriate hand tool, the main shaft 8 is prevented from turning and no excessive twisting force will be applied to the intermediate portion of the main shaft 8.

The turbine casing 4 defines therein a scroll passage 21, an inlet opening 21*a* of the scroll passage 21 which opens in a tangential direction, an outlet passage 22 extending in an axial direction and an outlet opening 22*a* for this outlet passage 22. And the direction of the flow of exhaust gas in these passages are indicated by the arrows in FIG. 1.

The back plate 23 is interposed between the turbine casing 4 and the lubrication unit casing 3 at its flange 23*a* which extends radially from the outer circumferential portion of the back plate 23. The connection between the turbine casing 4 and the lubrication unit casing 3 is accomplished by threading nuts 26 with stud bolts 24 provided in the turbine casing 4 by way of a ring member 25 in such a manner that the outer circumferential portion of the lubrication unit casing 3 and the flange 23*a* of the back plate 23 are held between the outer circumferential portion of the turbine casing 3 and the ring member 25.

A fixed vane member 27 for dividing the scroll passage 21 into an outer circumferential passage 21*b* and an inlet passage 21*c* is provided in a central portion of the scroll passage 21. This fixed vane member 27 comprises a tubular portion 28*a* provided in a central portion thereof, a disk portion 28*b* extending radially from the outer circumferential portion of an axially intermediate portion of the tubular portion 28*a*, and fixed vanes 29 which extend axially from the outer circumferential portion of the disk portion 28*b* towards the lubrication unit casing 3, and a turbine wheel 30 integrally mounted on the other end of the main shaft 8 is received in the tubular portion 28*a*. The tubular portion 28*a* is further fitted into an internal end portion of the outlet passage 22 by way of a pair of metallic seal rings 31 and an axial end portion of the fixed vane 29 is connected to the back plate 23 with bolts 32. The internal end of the tubular portion 28*a* defines a throat or a portion of a locally minimum cross section in cooperation with the back plate 23.

As best shown in FIG. 2, the outer circumferential portion of the fixed vane member 27 is provided with four of the fixed vanes 29 which surround the turbine wheel 30 in a concentric manner. These fixed vanes 29 are arcuate in shape and are arranged at an equal interval along a circumferential direction. The gaps between the fixed vanes 29 can be opened and closed with moveable vanes 34 which are each rotatably supported by a pin 33 which is fixedly attached to the corresponding moveable vane 34 and is received in a hole provided in the back plate 23. These moveable vanes 34 which are arcuate in shape by having a same curvature as that of the fixed vanes 29 are located along a same circle as the fixed vanes 29. And these moveable vanes 34 are pivoted at their portions adjacent the circumferential ends of the corresponding fixed vanes 29 in such a manner that they can only be moved into the interior of the circle.

Thus, the fixed vanes 29 and the corresponding moveable vanes 34 define the leading edges and the trailing edges of four smooth airfoil vanes, respectively, for the fluid flowing through the outer circumferential passage 21*b* of the scroll passage 21. And, when the moveable vanes 34 are in their fully closed positions, the trailing edges of the airfoils or the free ends of the moveable vanes 34 slightly overlap the leading edges of the adjacent air foils or the circumferential ends of the fixed vanes 29 remote from the pins 33 defining a certain gap $g_{min}$ therebetween. The external ends of the pins 33 supporting the moveable vanes 34 are connected to an actuator which is not shown in the drawings by way of an appropriate linkage mechanism 35 so that the opening angles of the moveable vanes 34 can be adjusted according to a certain control signal. Since the linkage mechanism 35 itself is not directly related to the present invention, its description is omitted here. An example of mechanism for actuating the moveable vanes 34 is described in greater detail in the copending patent application which was filed on even date.

A shield plate 36 is interposed between the back plate 23 of the turbine unit and the lubrication unit casing 3 and extends towards the rear face of the turbine wheel 30 so a to prevent the heat from the exhaust gas flowing through the exhaust gas turbine unit from being transmitted to the interior of the lubrication unit casing 3. Further, in order to prevent the exhaust gas of the turbine unit from leaking into the interior of the lubrication unit casing 3 a plurality of annular grooves 38 serving as a labyrinth seal are formed around the portion of the main shaft 8 which is passed through a central hole 37 of the lubrication unit casing 3.

Now the lubrication system of the turbosupercharger of the present embodiment is described in the following.

The upper end of the lubrication unit casing 3, in the sense of FIG. 1, is provided with a lubrication inlet hole 40 for introducing lubrication oil supplied from a lubrication oil pump which is not shown in the drawings to the radial bearing metals 13 and the thrust bearing metal 14 by way of a lubrication oil passage 41 formed in the interior of the lubrication unit casing 3. The lubrication oil which is ejected from each lubricated part is led out from a lubrication oil outlet 42 which is defined in the lubrication unit casing 3 and is then collected in an oil sump which is also not shown in the drawings.

In order to prevent the lubrication oil, in particular, the part of the lubrication oil which is supplied to the thrust bearing metal 14 from leaking into the compressor unit by adhering to the outer circumferential surface of the bushing 16 and contaminating the engine intake, the outer circumferential surface of the bushing 16 passes through a central hole 44 of the back plate 2 by way of a seal ring 43 and a guide plate 45 having a central hole receiving the bushing 16 therethrough is interposed between the back plate 2 and the thrust bearing metal 14. The lower portion of this guide plate 45 is curved away from the compressor unit.

The lubrication oil which has flowed out from the thrust bearing metal 14 is thrown off from the outer circumferential surface of the bushing 16 by centrifugal force and is received by the guide plate 45 to be ultimately returned to the oil sump.

The turbine unit of a turbosupercharger of this type can reach a substantially high temperature during its operation and control of the clearance on either side edge of each moveable vane 34 and possibility of mechanical seizure of the moveable vanes 34 due to uneven thermal expansion could be a problem. However, according to the present embodiment, since the moveable vanes 34 rotate in a gap defined between the back plate 23 and the disk portion 28*b* of the fixed vane member 27 which is a separate body from the turbine casing 4, the control of the gap for the moveable vanes 34 can be favorably accomplished. In particular, since the internal ends of the fixed vanes 29 are connected to the back plate 23 with threaded bolts 32, the connection between the back plate 23 and the fixed vane member 27 is highly rigid and the management and control of the clearance in the range of the motion of the moveable vanes 34 can be favorably accomplished.

Figure 3:
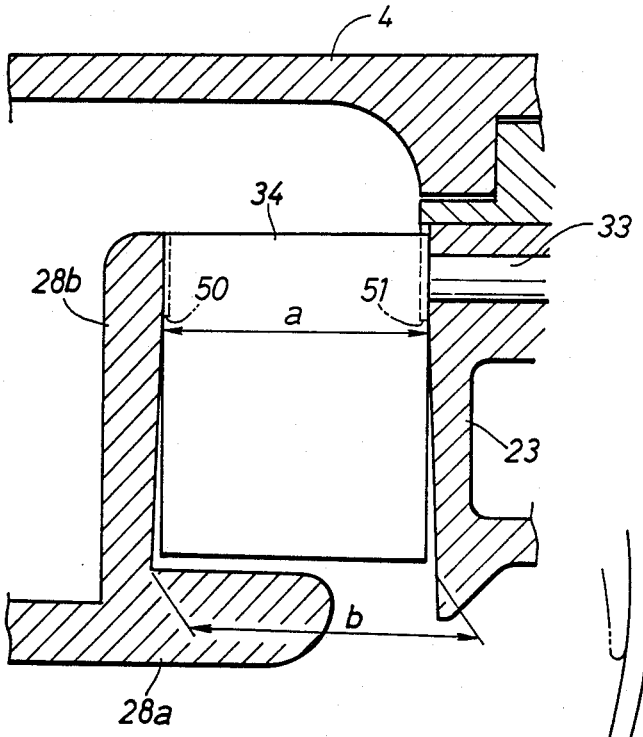
FIG. 3 is a sectional view taken along line III—III of FIG. 2 showing the taper of the gap accommodating the moveable vanes in exaggerated proportion.
Figure 4:
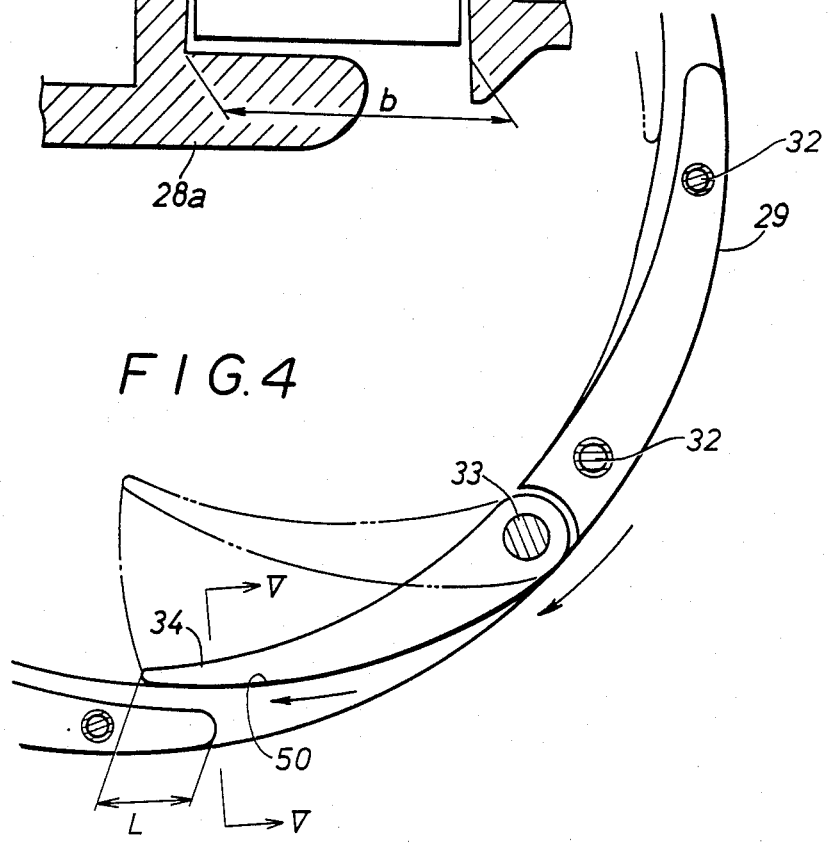
FIG. 4 is a magnified view showing a part of FIG. 2 in greater detail.

And, as shown in FIG. 3, since the width of the gap defined between the back plate 23 and the disk portion **28*b* for accommodating the axial width of the moveable vanes 34 in a freely rotatable manner is a in the outer periphery and b in the inner periphery ($a<b$) or, in other words, flares out from the outer periphery to the inner periphery, the tendency for the inner peripheral portion to deform inwardly due to thermal expansion can be compensated for and the mechanical seizure of the moveable vanes 34** can be avoided. In other words, when the opening of the variable nozzles is small the clearance of the moveable vanes is minimized for a maximum turbine efficiency, and when the opening of the variable nozzles is great and the performance of the turbine is relatively insensitive to the magnitude of the clearance of the moveable vanes is maximized so that the possibility of the mechanical seizure of the moveable vanes can be eliminated.

Figure 5:
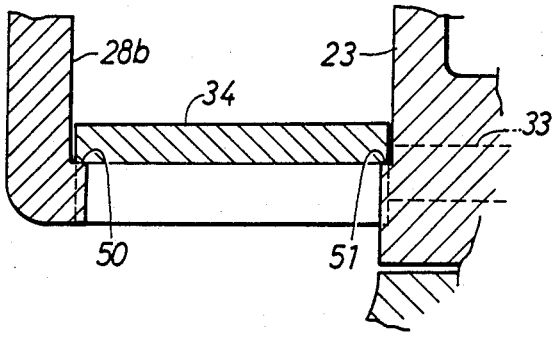
FIG. 5 is a sectional view taken along line V—V of FIG. 4.

Particularly when the opening degree of the moveable vanes 34 is at a minimum or, in other words, when the width of the gap between the moveable vanes 34 and the fixed vanes 29 is reduced to $g_{min}$, the leakage of the exhaust gas from the axial end surfaces of the moveable vanes 34 could be a problem. In the present embodiment, the axial dimension of the part which receives each of the moveable vanes can be accurately determined because the fixed vane member 27 is attached to the back plate 23 at its fixed vanes 29 and the leakage of exhaust gas from the axial end surfaces of the moveable vanes 34 can be limited to a relatively low level. Furthermore, since shoulders 50 and 51 are provided in the back plate 23 and the opposing surface of the disk portion **28*b* of the fixed vane member 27 as best shown in FIGS. 3 and 5 so as to be complementary to the axial ends of the moveable vanes 34 as best shown in FIG. 5, the leakage of exhaust gas from the axial end portions of the moveable vanes 34** is minimized and the efficiency of the turbine can be favorably improved.

Now the action of the present embodiment is described in the following.

When the rotational speed of the engine is low and the flow rate of the exhaust gas is small, as shown by the solid lines in FIG. 2, by closing the moveable vanes 34, the width of the nozzle gaps defined in the overlapped portions between the leading edge portions of the fixed vanes 29 and the trailing edge portions of the moveable vanes 34 is reduced to the minimum value $g_{min}$. As a result, the flow of the exhaust gas is restricted and accelerated to a maximum extent and after turning into a spiral flow in the inlet passage **21*c* between the fixed vane members 27 and the turbine wheel 31 reaches the turbine wheel 30 so that the turbine wheel 31** is driven by the accelerated exhaust gas and the engine intake can be supercharged to the engine even in a low speed range of the engine.

When the engine speed is high and a sufficient supercharging is taking place, the nozzles defined between the fixed vanes 29 and the moveable vanes 34 are opened wider as shown by the imaginary lines in FIG. 2. As a result, the exhaust gas is not accelerated and the back pressure of the engine exhaust system is reduced since the exhaust gas can reach the turbine wheel 30 without encountering any significant flow resistance.

In the above described structure of variable nozzles in which the nozzles are defined between neighboring fixed vanes and moveable vanes, the length of the overlap L between the leading edge of each fixed vane and the trailing edge of the adjacent moveable vane strongly affects the performance of the turbine. For instance, if the overlap L along the direction of the fluid flow is excessive, the resistance to the fluid flow becomes so great that not only the fluid flow efficiency drops but also an aerodynamic lift acting upon the moveable vanes could impair the precision of control. On the other hand, if the overlap L is too small, the smoothing of the fluid flow tends to be insufficient and this also causes reduction in the fluid flow efficiency.

According to the experiments conducted by the inventors based upon such a recognition, it was found that a relatively high efficiency can be obtained if the ratio of the overlap L relative to the axial width of the moveable vanes is from 20 to 60%. In particular, when this ratio is between 20 and 30%, it was found that the most favorable results can be obtained in terms of efficiency and ill effects of the lift.

Figure 6:
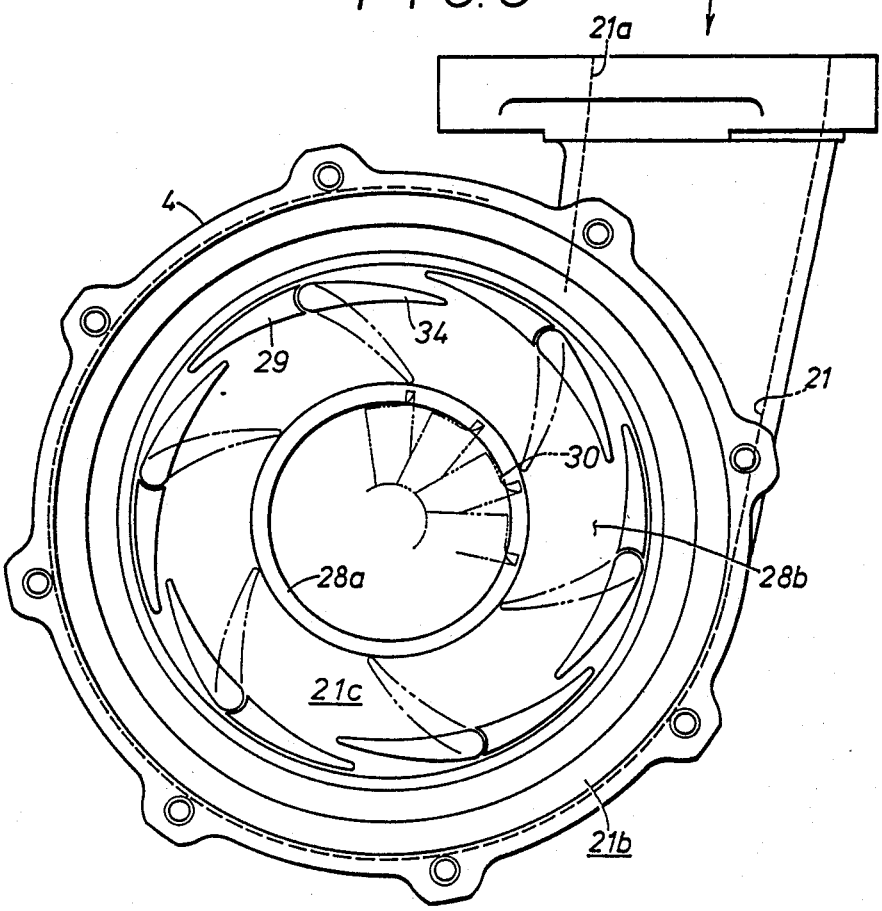
FIGS. 6 to 8 are views similar to FIG. 2 showing different embodiments of the present invention.
Figure 7:
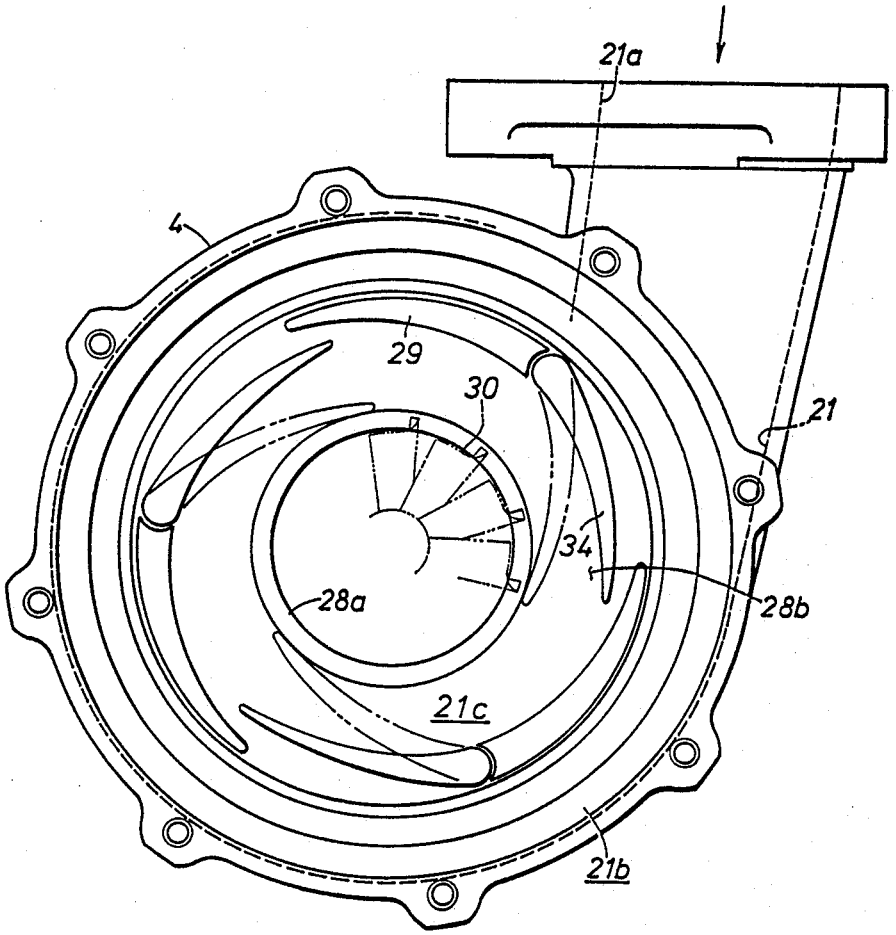
Figure 8:
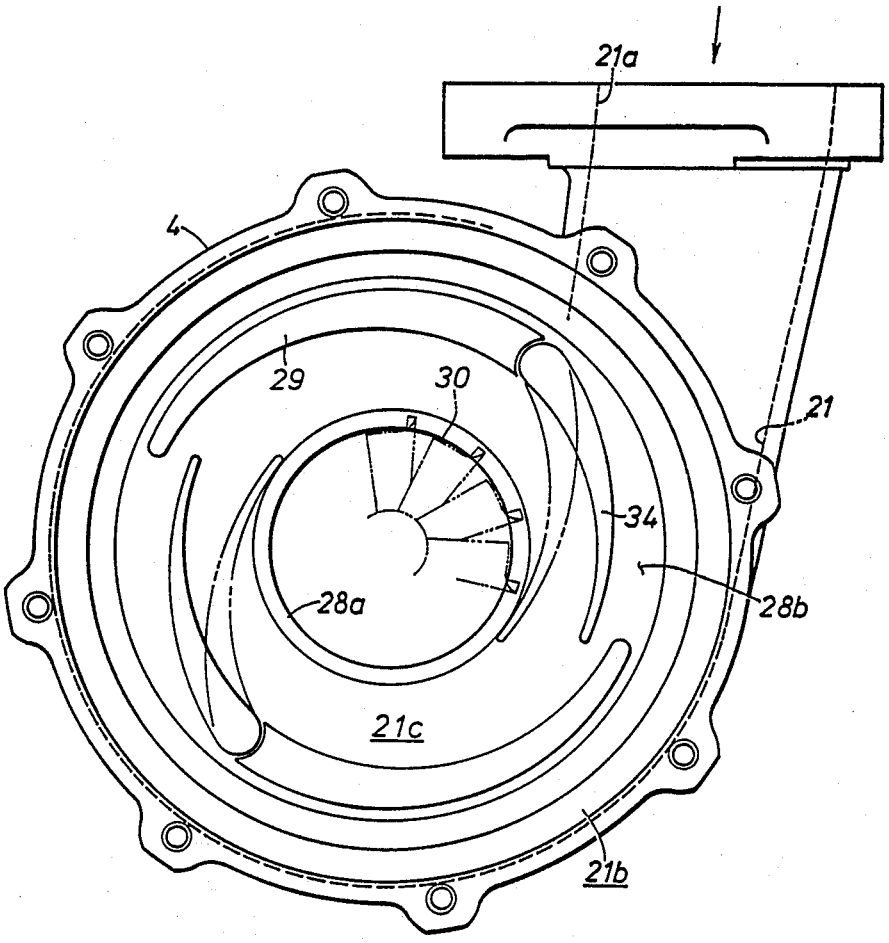

FIGS. 6 to 8 show different embodiments of the present invention and those parts corresponding to those of the previous embodiment are denoted by like numerals.

In the embodiment shown in FIG. 6, there are six fixed vanes 29 and six moveable vanes 34. In the embodiment shown in FIG. 7, three fixed vanes 29 and six moveable vanes are provided. In the embodiment shown in FIG. 8, two fixed vanes 29 and two moveable vanes 34 are provided. In all of these embodiments, each moveable vane 34 is associated with a different one of the fixed vanes 29 and defines a substantially smooth airfoil with the fixed vane 29. The circumferential positions of the moveable and fixed vanes can be freely selected but it is preferred that one of the moveable vanes aligns with the inlet opening **21*a* of the scroll passage 21 as exemplified by the embodiments shown in FIGS. 7 and 8**. This latter feature is advantageous in reducing the flow resistance to the gas introduced into the turbine and is of a greater significance as there are a fewer number of vanes.

Thus, according to the present invention, since the flow resistance to the fluid flow entering the turbine can be minimized and the range of the variation of the variable nozzles can be expanded, improvement of controllability of the turbosupercharger can be accomplished and the need for a waste gate valve can be eliminated. Additionally, the present invention can contribute to the improvement of turbine efficiency and improvement of engine performance when the invention is applied to a turbosupercharger for the engine.

Furthermore, according to the present invention, the control and management of the clearance of the moveable vanes are simplified with the result that a significant advantage can be obtained in improving the facility of manufacture and the reliability of the turbine. And, since the clearance of the moveable vanes when the opening degree of the variable nozzles is at a minimum value is minimized and the efficiency of the turbine can be improved.

Although the present invention has been shown and described with reference to the preferred embodiment thereof, it should not be considered as limited thereby. Various possible modifications and alterations could be conceived of by one skilled in the art to any particular embodiment, without departing from the scope of the invention.

What we claim is:

1. A radial in-flow turbine comprising a turbine wheel, a turbine scroll passage defined in a turbine casing around the turbine wheel for introduction of gas to the turbine wheel, and an axial central passage defined in the turbine casing for ejection of gas from the turbine wheel. wherein:

a plurality of variable nozzles, having an axial width, are arranged concentrically with respect to the turbine wheel and inside of the turbine casing and outside of an annular throat section defined inside the turbine casing concentric to the turbine wheel and having a locally minimum axial width less than said nozzle axial width, said variable nozzles are defined by fixed vanes and moveable vanes.

2. A variable capacity turbine as defined in claim 1, wherein the fixed vanes are comprised of arcuate vanes arranged along a circle which is concentric to the turbine wheel and the moveable vanes are adapted to rotate along a plane which is perpendicular to the axial line of the turbine.

3. A variable capacity turbine as defined in claim 2, wherein the moveable vanes are each provided with a center of rotation at its base end which is adjacent to one of the fixed vanes and are adapted to rotate between a most closed position which is substantially aligned with the circle and a most open position which is inclined inwardly with respect to the circle.

4. A variable capacity turbine as defined in claim 3, wherein each of the fixed vanes and the corresponding moveable vane define a substantially continuous and smooth airfoil.

5. A variable capacity turbine as defined in claim 4, further comprising:

a fixed vane member having a disk portion which defines a surface opposing an inner surface of a back plate which covers an axial end of the turbine casing remote from an axial end of the central axial passage and the fixed vanes arranged at an equal interval along a peripheral portion of the disk portion radially outside of the outer periphery of the turbine wheel and extend axially towards the back plate;

moveable vane members having the moveable vanes and pivot means for supporting the moveable vanes in a rotatable manner along and between the opposing surfaces of the disk portion and the back plate;

fastener means for connecting an axial free ends of the fixed vanes to the back plate.

6. A variable capacity turbine as defined in claim 5, wherein the moveable vanes are pivotally supported by the back plate.

7. A variable capacity turbine as defined in claim 6, wherein the gap defined by the back plate and the disk portion for receiving one of the moveable vane is flared from an outer circumferential portion thereof to an inner circumferential portion thereof.

8. A variable capacity turbine as defined in claim 7, wherein the disk portion of the fixed vane member is provided with a central tubular portion which is adapted to be connected to an internal end of the axial passage in a substantially air tight and floating manner.

9. A variable capacity turbine as defined in claim 8, wherein the minimum opening angle of the moveable vanes is determined by the side edges of the moveable vanes contacting complementary shoulders formed in at least one of the back plate and the disk portion of the fixed vane member.

10. A variable capacity turbine as defined in claim 9, wherein an overlap along the circumferential direction is provided between the leading edge of each of the fixed vanes and the trailing edge of the corresponding moveable vane, the ratio of this overlap to the axial width of the moveable vane being from 20 to 60%.

11. A variable capacity turbine as defined in claim 10, wherein the ratio of the overlap to the axial width of the moveable vane is from 20 to 30%.

12. A variable capacity turbine as defined in claim 1, wherein the opening areas of the variable nozzles are each defined by a fixed axial width and a variable width extending in a direction perpendicular to the axial direction.

13. A turbine comprising a turbine wheel, a turbine scroll passage defined in a turbine casing around the turbine wheel for introduction of gas to the turbine wheel, and an axial central passage defined in the turbine casing for ejection of gas from the turbine wheel, comprising:

a plurality of fixed vanes and movable vanes arranged around the turbine wheel in alternating fashion located inside said turbine casing and outside of an annular throat section;

each of the movable vanes being pivoted at its base end adjacent to a trailing edge of an adjacent one of the fixed vanes rotatable between a first position, in which the fixed vanes and movable vanes are substantially aligned with a circle and a free end of the movable vane adjoins a leading edge of the adjacent fixed vane along a circumferential direction so as to define a minimally open nozzle therebetween, and a second position, in which said movable vanes are rotated inwardly toward the turbine wheel so as to define a maximally open nozzle between the free end of each of the movable vanes and the leading edge of the corresponding adjacent fixed vane.

14. A variable capacity turbine as defined in claim 13, further comprising:

a fixed vane member having a disk portion which defines a surface opposing an inner surface of a back plate which covers an axial end of the turbine casing remote from an inlet end of the central axial passage and the fixed vanes arranged at an equal interval along a peripheral portion of the disk portion radially outside of the outer periphery of the turbine wheel and extend axially towards the back plate;

moveable vane members having the moveable vanes and pivot means for supporting the moveable vanes with respect to the back plate in a rotatable manner along and between the opposing surfaces of the disk portion and the back plate in such a manner that each of the moveable vanes and the corresponding fixed vane define a substantially smooth and continuous airfoil; and fastener means for connecting an axial free ends of the fixed vanes to the back plate.

15. A variable capacity turbine as defined in claim 13, wherein the free end of each of the movable vanes overlaps the leading edge of the adjacent fixed vane along a circumferential direction when the movable vanes are rotated outwardly away from the turbine wheel so as to define a minimally open nozzle between the moveable vane and the fixed vane.

16. A radial in-flow turbine comprising a turbine wheel, a turbine scroll passage defined in a turbine casing around the turbine wheel for introduction of gas to the turbine wheel, and an axial central passage defined in the turbine casing for ejection of gas from the turbine wheel, wherein:

a plurality of variable nozzles located inside said turbine casing and outside of an annular throat section, said nozzles comprised of a plurality of moveable vanes and fixed vanes arranged around the turbine wheel; the moveable vanes and fixed vanes being substantially aligned along a circle concentric to the turbine wheel and presenting substantially smooth inner and outer circumferential contour surfaces when the moveable vanes are positioned to define a minimally open state of the variable nozzles.

17. A radial in-flow turbine comprising a turbine wheel, a turbine scroll passage defined in a turbine casing around the turbine wheel for introduction of gas to the turbine wheel, and an axial central passage defined in the turbine casing for ejection of gas from the turbine wheel, wherein:

a plurality of variable nozzles located inside said turbine casing and outside of an annular throat section, said nozzles comprised of a plurality of moveable vanes and fixed vanes having ends, said moveable vanes and fixed vanes arranged around the turbine wheel, and each of the moveable vanes and the corresponding fixed vanes define an airfoil having a substantially smooth contour, the end of each of the fixed vanes remote from the corresponding moveable vane defining the leading edge of the airfoil while the end of the moveable vane remote from the corresponding fixed vane defines the trailing edge of the airfoil.

* * * * *